US010566152B2

(12) United States Patent
Okada

(10) Patent No.: US 10,566,152 B2
(45) Date of Patent: Feb. 18, 2020

(54) ROTARY SWITCH DEVICE

(71) Applicant: ALPHA CORPORATION, Yokohama-shi, Kanagawa (JP)

(72) Inventor: Takahiro Okada, Yokohama (JP)

(73) Assignee: ALPHA CORPORATION, Yokohama-shi, Kanagawa (JP)

( * ) Notice: Subject to any disclaimer, the term of this patent is extended or adjusted under 35 U.S.C. 154(b) by 0 days.

(21) Appl. No.: 16/192,832

(22) Filed: Nov. 16, 2018

(65) Prior Publication Data

US 2019/0088429 A1 Mar. 21, 2019

Related U.S. Application Data

(63) Continuation of application No. PCT/JP2017/018382, filed on May 16, 2017.

(30) Foreign Application Priority Data

May 17, 2016 (JP) ..... 2016-099039

(51) Int. Cl.
*H01H 19/10* (2006.01)
*H01H 19/08* (2006.01)
(Continued)

(52) U.S. Cl.
CPC ..... *H01H 19/10* (2013.01); *H01H 19/08* (2013.01); *H01H 19/14* (2013.01); *H01H 19/48* (2013.01);
(Continued)

(58) Field of Classification Search
CPC ..... H01H 19/10; H01H 19/08; H01H 19/14; H01H 19/48; H01H 2201/024;
(Continued)

(56) References Cited

U.S. PATENT DOCUMENTS 6,096,988 A 8/2000 Tsukamoto et al.
2015/0206665 A1 7/2015 Goto et al.
(Continued)

FOREIGN PATENT DOCUMENTS

CN 102683081 A 9/2012
DE 8904537 U1 8/1989
(Continued)

OTHER PUBLICATIONS

International Search Report dated Aug. 22, 2017 for PCT/JP2017/018382.
(Continued)

*Primary Examiner* — Edwin A. Leon
*Assistant Examiner* — Lheiren Mae A Caroc
(74) *Attorney, Agent, or Firm* — Drinker Biddle & Reath LLP

(57) ABSTRACT

A rotary switch device includes a terminal base to which a center portion contact and a fixed contact member are fixed, a movable contact member, and a support portion. The movable contact member includes a contact protrusion part which is pressed in contact with the center portion contact at one end of the movable contact member and a first contact surface which is in contact with the fixed contact member at another end of the movable contact member, and which is operated to rotate around the center portion contact so as to short-circuit between the center portion contact and the fixed contact member at a conductive rotation position.

5 Claims, 8 Drawing Sheets

(51) Int. Cl.
*H01H 19/14* (2006.01)
*H01H 19/48* (2006.01)

(52) U.S. Cl.
CPC . *H01H 2201/024* (2013.01); *H01H 2203/002* (2013.01); *H01H 2205/028* (2013.01); *H01H 2231/026* (2013.01); *H01H 2239/044* (2013.01)

(58) Field of Classification Search
CPC ..... H01H 2203/002; H01H 2205/028; H01H 2231/026; H01H 2239/044; H01H 19/02
USPC ..... 200/564, 570, 571, 336, 11 R, 14, 11 A, 200/11 J, 11 TW
See application file for complete search history.

(56) References Cited

U.S. PATENT DOCUMENTS

2017/0040125 A1 2/2017 Okada
2018/0082806 A1* 3/2018 Okada ..... H01H 19/02
2019/0066948 A1* 2/2019 Okada ..... H01H 19/08

FOREIGN PATENT DOCUMENTS

| | | | |
|---|---|---|---|
| JP | H05-006562 | U | 1/1993 |
| JP | H11-086680 | A | 3/1999 |
| JP | 3126688 | U | 11/2006 |
| JP | 2015-103495 | A | 6/2015 |
| WO | WO-2015/163430 | A1 | 10/2015 |

OTHER PUBLICATIONS

International Search Report/Written Opinion dated Aug. 22, 2017 for PCT/JP2017/018382 [non-English language].
Chinese Office Action dated Sep. 29, 2019 that issued in corresponding Chinese patent application No. 201780030442.2, along with its English-language translation, attached.
Extended European Search Report dated Dec. 5, 2019 in European Patent Application No. 17799386.2.

* cited by examiner

ROTARY SWITCH DEVICE

CROSS REFERENCE TO RELATED APPLICATIONS

This application is a continuation of PCT application No. PCT/JP17/018382, which was filed on May 16, 2017 based on Japanese Patent Application (No. 2016-099039) filed on May 17, 2016, the contents of which are incorporated herein by reference.

BACKGROUND OF THE INVENTION

Field of the Invention

The present invention relates to a rotary switch device.

Description of Related Art

Patent literature 1 discloses a rotary switch device in which a movable contact member is rotated to be in contact with a fixed contact. In the rotary switch device of patent literature 1, a circular first fixed contact portion is exposed to be disposed at a center portion of a terminal base formed of an insulating material. Second and third fixed contact portions are disposed so as to surround the first fixed contact portion.

The movable contact member (contact plate) is rotatively driven around the first fixed contact portion held by a rotor, and in a case where conduction is not established to the third fixed contact portion, is supported by a traveling portion or the second fixed contact portion of which one end is formed in the first fixed contact portion and the other end is formed in the terminal base.

[Patent Literature 1] JP-A-2015-103495

In the rotary switch device of patent literature 1, a contact portion of the contact plate with the third fixed contact portion is in a floating state until contact with the third fixed contact portion, and is not in contact with another member, so that there is an advantage that wear of the contact portion or the like does not occur. However, a region corresponding to the second fixed contact portion is always in pressure contact with the third fixed contact portion or the following traveling portion.

That is, since a contact surface with the second fixed contact portion substantially abuts against the second fixed contact portion and slides on the second fixed contact portion or the traveling portion, many abrasion powders are generated. The abrasion powder is supplied to a movement path to the third fixed contact portion so as to be swept by the contact plate upon a movement of the contact plate, and when a supply amount thereof increases, short circuit with the second fixed contact portion and the third fixed contact portion occurs.

In addition, when the abrasion powder moves onto the third fixed contact portion, the abrasion powder is sandwiched between a contact surface of the sliding contact plate and the fixed contact portion to damage both or one thereof. For example, in order to correspond to a low current specification, in a case where an anticorrosive film is formed on the contact surface, the film peels off to cause contact failure.

SUMMARY

One or more embodiments provide a rotary switch device in which performance deterioration due to a long-term use is prevented.

According to one or more embodiments, a rotary switch device includes a terminal base 3 to which a center portion contact 1 and a fixed contact member 2 are fixed, a movable contact member 6, and a support portion 8. The movable contact member 6 includes a contact protrusion part 4 which is pressed in contact with the center portion contact 1 at one end of the movable contact member and a first contact surface 5 which is in contact with the fixed contact member 2 at another end of the movable contact member, and is operated to rotate around the center portion contact 1 so as to short-circuit between the center portion contact 1 and the fixed contact member 2 at a conductive rotation position. The support portion 8 is formed in the terminal base 3 and supports an edge corner portion 7 along a rotation direction when the first contact surface 5 of the movable contact member 6 is operated to rotate. The movable contact member 6 configured to slide on the support portion 8 with the edge corner portion 7 as a sliding contact portion and moves to the conductive rotation position where the contact surface 5 is in contact with the fixed contact member 2.

The movable contact member 6 having the contact protrusion part 4 and the contact surface 5 at the both ends is operated to rotate around the center portion contact 1 in a state where the contact protrusion part 4 is in pressure contact with the center portion contact 1, and moves on the fixed contact member 2 so as to short-circuit between the fixed contact member 2 and the center portion contact 1.

In a non-contact state with the fixed contact member 2, the other end portion of the movable contact member 6, that is, the corner portion 7 of the contact surface 5, more precisely when the fixed contact member 2 is operated to rotate, the corner portion 7 along the rotation direction is supported by the support portion 8 formed in the terminal base 3, and when the rotational operation is applied, the corner portion 7 slides on the support portion 8 to move to a predetermined position.

In one or more embodiments in which the movable contact member 6 slides with the corner portion 7 of the contact surface 5 as a sliding portion with the support portion 8, since a contact area between the movable contact member 6 and the support portion 8 is reduced, generation of abrasion powder can be suppressed and it is possible to effectively prevent problems due to the generation of the abrasion powder.

In addition, in a case where a plating film is formed on the contact surface 5 of the movable contact member 6, since a base material is exposed after a small amount of peeling powder is generated, harmful process of wear is effectively prevented.

According to one or more embodiments, the support portion 8 may support the movable contact member 6 at a high position with respect to a plane of the fixed contact member 2, and in a supporting state, may hold the movable contact member 6 in a state that the movable contact member is rotatable in a direction perpendicular to the plane.

For example, the support portion is formed as a protrusion which is long in a moving direction of the movable contact member 6 having an inclined surface abutting against the corner portion 7 of the contact surface 5 as a side wall, and a recessed groove is formed at a confronting portion with the contact surface 5. Therefore, it is also possible to support the movable contact member 6 in a state where the movable contact member 6 holds a rotational posture in which the contact surface 5 is in contact with the fixed contact member 2. In addition, as in the present invention, if an abutting portion against the corner portion 7 of the contact surface 5 is set to be higher than a height at the time of contact with the fixed contact member 2, and the fixed contact member 2 is lifted with respect to the rotational posture at the time of contact with the fixed contact member 2, it is possible to maintain the non-contact state of the contact surface 5 with a simple structure.

According to one or more embodiments, the first contact surface 5 of the movable contact member 6 and a second contact surface 5 of the fixed contact member 2 may be formed in rectangular shapes in which a contact point to the other moves from one end portion to another end portion in a predetermined connecting operation angle from a start of a contact of both the fixed contact member and the movable contact member, and the movable contact member 6 may use the corner portion 7 on a contact end point side as the sliding contact portion with the support portion 8.

In the present invention, as the movable contact member 6 is operated to rotate, both the contact surfaces 5 are first contact (contact start point) with each other at one end portion and then the contact portions move to the other end portion, and final contact regions are in contact with each other. As a result, even in a case of being operated under high current specification, a deteriorated portion of the contact surface due to an arc discharge at the time of the start of the contact is limited to the contact start point and good contact in the final contact region is guaranteed, so that it is possible to use the rotary switch device in specifications of both low and high current.

In addition, if the corner portion 7 on the contact end point side is used as the sliding contact portion with the support portion 8, it is possible to prevent the sliding contact portion from being damaged due to molten splashes or the like by the arc discharge.

According to one or more embodiments, conductive processing for corrosion resistant may be applied to the first contact surface 5 of the movable contact member 6 and the second contact surface 5 of the fixed contact member 2.

In this case, it is possible to share the rotary switch device with the low current specification and the high current specification.

The conductive processing for corrosion resistant is applied to the contact surface 5, so that corrosion is prevented and the contact surface is kept clean without resorting to a cleaning operation by sliding at high contact pressure.

As a result, even in a case where the rotary switch device is used for the low current, corrosion of the contact surface does not occur and occurrence of poor contact due to generation of an insulating film can be prevented.

In addition, since both the contact points move from one end portion to the other end portion together with the rotation of the movable contact member 6, even if damage of the film of the contact portion occurs due to the arc discharge, in the connecting operation angle, contact fault does not occur because both the contact surfaces maintain a clean surface state.

A conductive processing for corrosion resistant surface can be obtained by applying silver plating to a surface of a base material made of a conductive metal such as copper.

According to one or more embodiments, it is possible to use a same structure even for the high current, so that it is not necessary to set plural types of rotary switches for each rated current.

According to one or more embodiments, a rotary switch device may further include a plurality of movable contact members 6 that travel on a same circular moving locus.

In this case, since a space can be effectively used, it is possible to reduce the device in size.

According to one or more embodiments, since the sliding portion of the movable contact member with the support portion can be separated from the contact portion with the fixed contact member, high connection reliability can be maintained for a long period of time.

DETAILED DESCRIPTION

Figure 1:
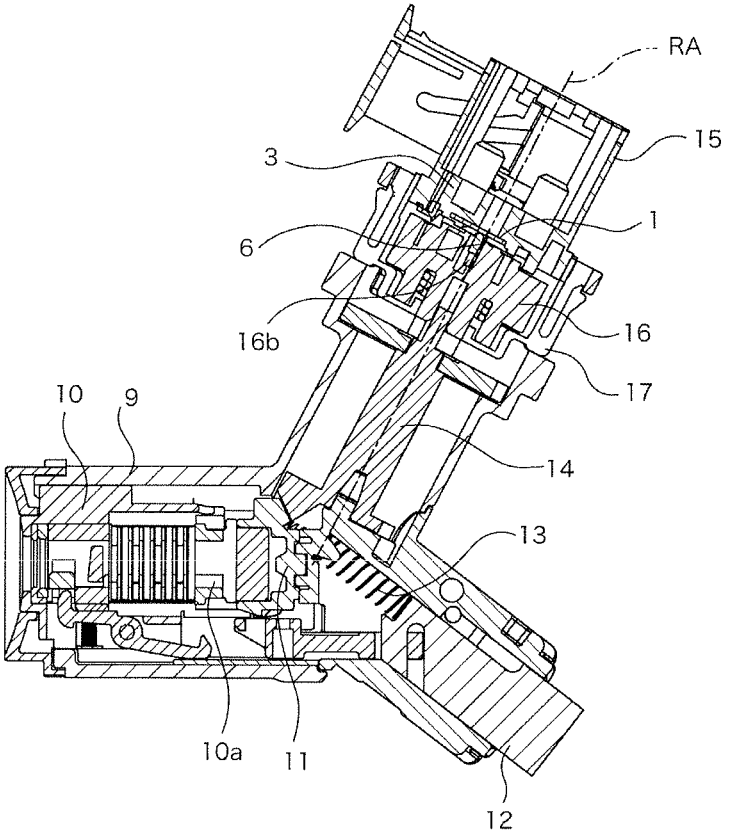
FIG. 1 is a sectional view illustrating a steering lock apparatus.

A rotary switch device of the present invention configured as an ignition switch used in a steering lock apparatus is illustrated in FIG. 1 and the following. The steering lock apparatus of the example includes a cylinder lock 10 accommodated in a housing 9 and a cam member 11 connected to a terminal of a plug 10*a* of the cylinder lock 10, and is fixed to a steering column (not illustrated).

The housing 9 is provided with a lock piece 12 which moves between a lock position which advances and retreats in a direction intersecting a rotation axis of the cam member 11 at a predetermined angle and protrudes into the steering column, and an unlock position which is accommodated in the housing 9. The lock piece 12 is urged to a direction of the lock position by a compression spring 13 and when the plug 10*a* of the cylinder lock 10 is operated to rotate from a lock rotation position, the lock piece 12 moves from the lock position where the lock piece 12 is locked to a steering shaft to the unlock position where the lock piece 12 is released, and the steering shaft can be operated.

In addition, the ignition switch is connected to the housing 9 to cause predetermined terminals to conduct in accordance with the rotation of the plug 10*a* and a power supply state to an electrical system of a vehicle to be changed. In order to transmit the rotational operation of the plug 10*a* to the ignition switch, a connecting bar 14 which meshes with the cam member 11 and rotates together with the cam member 11 is disposed in the housing 9.

Figure 2:
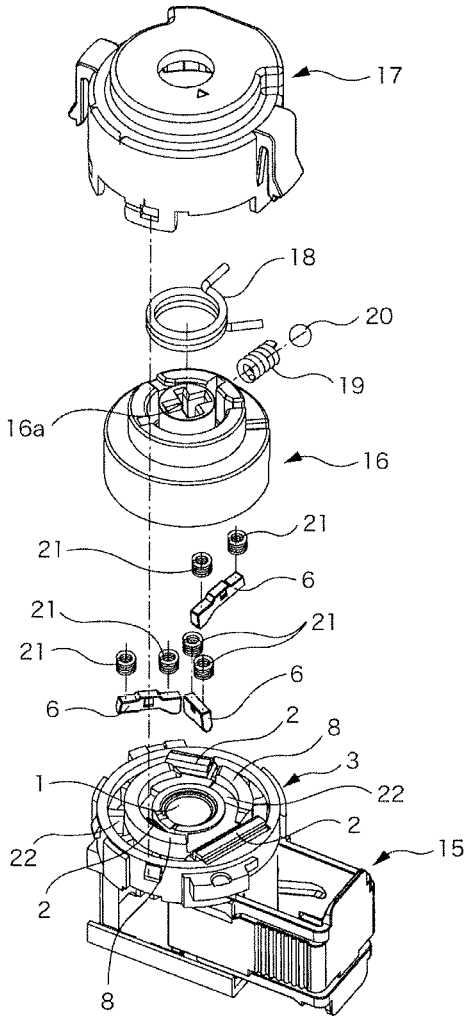
FIG. 2 is an exploded perspective view of an ignition switch.

As illustrated in FIG. 2, the ignition switch includes a switch case 15 having a terminal base 3 having a circular shape in plan view, a rotation movable portion 16 rotatable around a center of the terminal base 3 with respect to the switch case 15, and a switch cover 17 connected to the switch case 15 to cover the rotation movable portion 16. A center portion contact 1 and a fixed contact member 2 are disposed in the terminal base 3 formed by an insulating material in a state of being exposed to a rotation boundary surface with the rotation movable portion 16.

The center portion contact 1 and each fixed contact member 2 are drawn into the switch case 15 via wiring.

The rotation movable portion 16 is formed of an insulating material and connecting bar and a connecting hole 16*a* are formed at one end portion. The rotation movable portion 16 is urged only when returning from START position to ON position by a torsion spring 18, and moderately rotates at an appropriate connecting operation angle by fitting a click ball 20 urged by a click spring 19 into a groove of an inner wall of the switch cover 17.

Furthermore, a plate-like movable contact member 6 having a predetermined plate thickness is accommodated in the rotation movable portion 16 so that a plate thickness surface faces the terminal base 3. The movable contact member 6 includes a contact protrusion part 4 of a V-shaped protrusion at one end and a flat contact surface 5 at the other end, a rounded chamfer is formed at a tip of the contact protrusion part 4 in order to keep a good contact state when the movable contact member 6 is in pressure contact with the center portion contact 1 which is described later. As illustrated in FIG. 8B, the flat contact surface 5 in the movable contact member 6 is formed in a V shape so that the movable contact member 6 smoothly rides on the support portion 8 when the flat contact surface 5 in the movable contact member 6 moves back and forth between the fixed contact member 2 and the support portion 8.

As described above, the movable contact member 6 is formed in the V shape so that timing at which the movable contact member 6 is in contact with the fixed contact member 2 can be made earlier.

Three pieces of the movable contact members 6 formed as described above are used corresponding to the respective fixed contact members 2 which are described later.

As illustrated in FIG. 1, each movable contact member 6 is accommodated in an accommodation groove 16*b* formed in the rotation movable portion 16, is movable in a direction along the rotation axis (RA), and is urged to a surface side of the terminal base 3 by compressions springs 21 accommodated in the rotation movable portion 16 and pressing the contact protrusion part 4 and a back surface of the contact surface 5.

Figure 9:
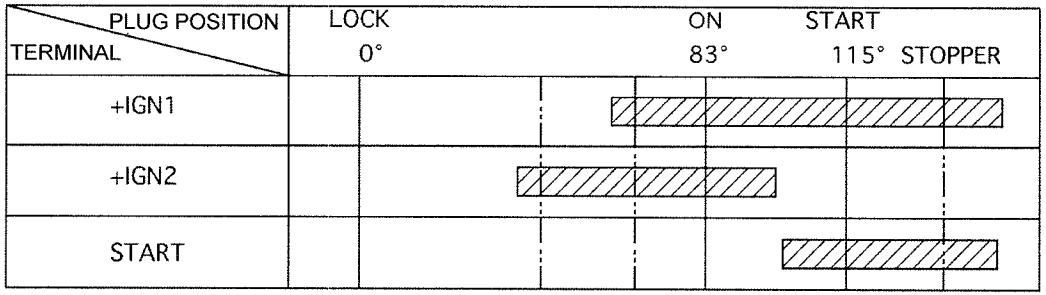
FIG. 9 is a flowchart illustrating a conduction state of a contact of the ignition switch.

The ignition switch according to the example is formed to output a power supply voltage input from a power supply terminal to three output terminals of +IGN1, +IGN2, and START when the plug 10*a* is operated to rotate in the order of LOCK, ON, and START positions. FIG. 9 illustrates a power supply operation to each terminal and power is supplied in the order of the +IGN2 terminal and the +IGN1 terminal by the movement of the plug 10*a* from the LOCK position to the ON position. Thereafter, when the plug 10*a* is rotated to the START position, first, the power supply to the +IGN2 terminal is stopped, and then the power supply is started to the START terminal in addition to the +IGN1 terminal where the power supply state is maintained.

The sequence described above is realized by short-circuiting the center portion contact 1 disposed at a center portion of the terminal base 3 and the fixed contact member 2 disposed around the center portion contact 1 and connected to the +IGN1 terminal, the +IGN2 terminal, and the START terminal by the movable contact member 6 described above.

Figure 7A:
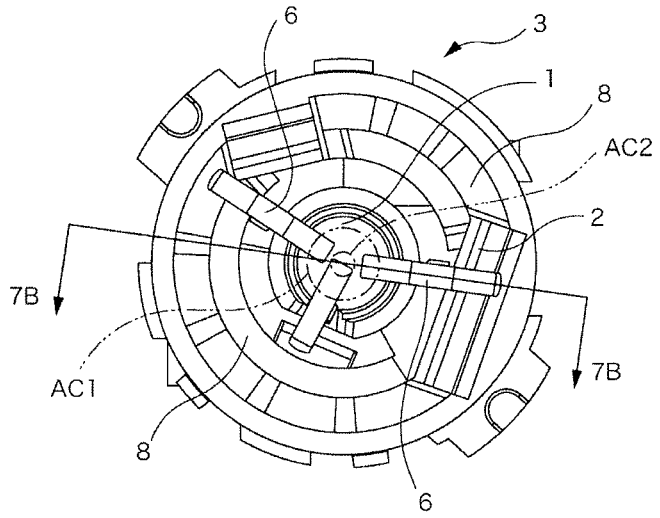
FIG. 7A is a plan view illustrating a position of the movable contact member at the ON position and FIG. 7B is a sectional view taken along line 7B-7B of FIG. 7A.
Figure 7B:
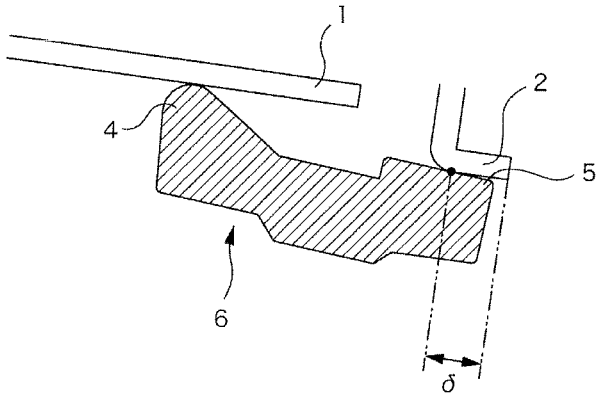

If sliding loci of the movable contact members 6 in the center portion contact 1 overlap each other, a chance of wear at an overlapping portion increase. In order to prevent this, as illustrated by chain lines in FIG. 7A, the movable contact member 6 that is in contact with and disconnected from the +IGN1 terminal and the movable contact member 6 that is in contact with and disconnected from the +IGN2 terminal of which rotation ranges overlap each other move along arcs (AC1 and AC2) having different diameters on the center portion contact 1.

Silver plating as conductive processing for corrosion resistant is applied to the surfaces of the fixed contact member 2 and the movable contact member 6 in order to prevent occurrence of corrosion on the contact surface and enhance contact reliability without requiring a self-cleaning operation by a high contact pressure.

Figure 3:
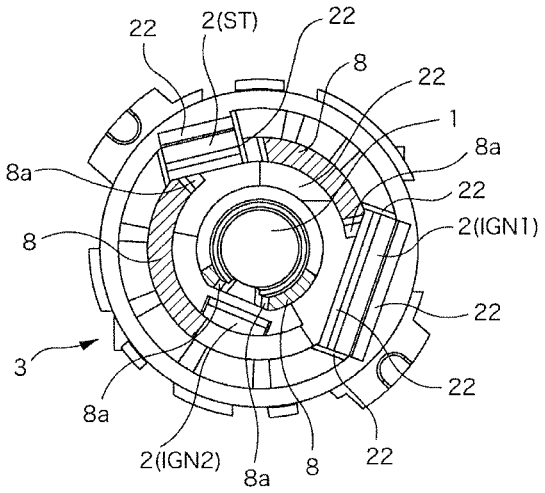
FIG. 3 is a view illustrating an arrangement of fixed contacts.
Figure 5A:
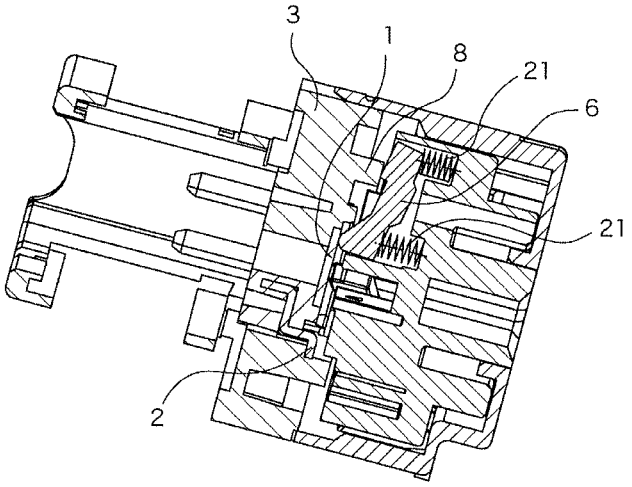
FIG. 5A is a sectional view taken along line 5A-5A of FIG. 4
Figure 5B:
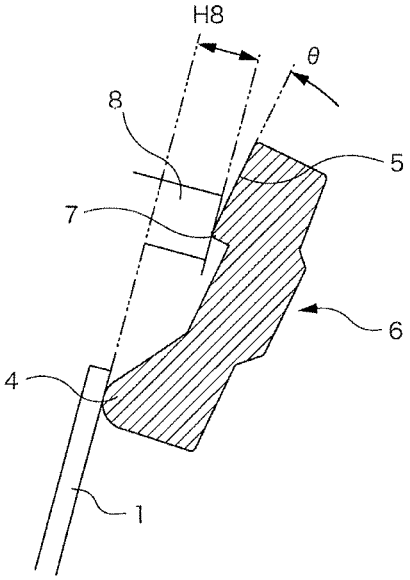
FIG. 5B is an enlarged view of a main portion of FIG. 5A.
Figure 6A:
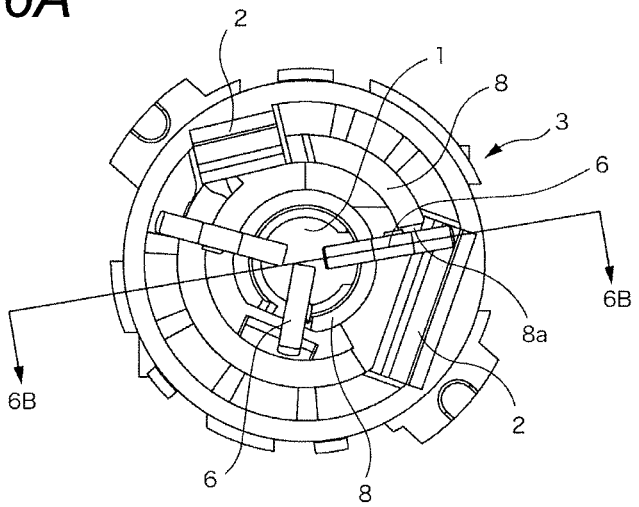
FIG. 6A is a plan view illustrating a state of an initial stage of contact to an ON position and FIG. 6B is a sectional view taken along line 6B-6B of FIG. 6A.
Figure 6B:
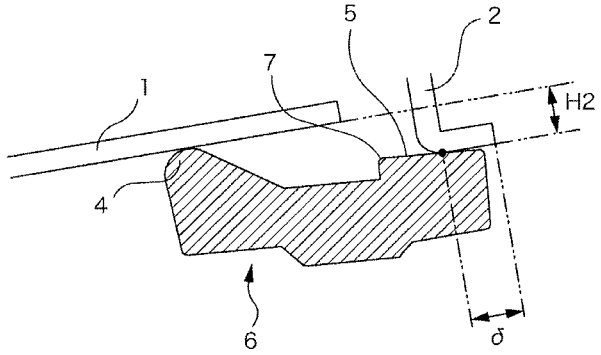

As illustrated in FIG. 3, the three fixed contact members 2 are respectively disposed at terminal positions of three support portions 8 formed in the terminal base 3. Each fixed contact member 2 is formed in a rectangular shape intersecting the support portion 8, the support portion 8 is disposed on two concentric circles with respect to the center of the terminal base 3, and as illustrated in FIG. 5B, is formed as a protrusion which is higher than the center portion contact 1 by H8. As illustrated in FIG. 6B, the fixed contact member 2 is disposed so that the surface thereof is higher than the center portion contact 1 by H2 and lower than the support portion 8.

Furthermore, the center portion contact 1, the fixed contact member 2, and the support portion 8 are formed in a floating island shape of which a periphery is surrounded by a recessed portion 22, and propagation of the abrasion powders between the fixed contact members 2, and between the support portion 8 and the fixed contact member 2, and coagulated powder of molten splashes due to the arc discharge is regulated.

The support portion 8 supports an opposite end of the movable contact member 6 with respect to the contact protrusion part 4 in a nonconductive state where the movable contact member 6 is not in contact with the fixed contact member 2, and functions as a traveling path when the movable contact member 6 is operated to rotate.

As illustrated in FIG. 5B, the support of the movable contact member 6 is carried out by placing the corner portion 7 on the contact protrusion part 4 of the contact surface 5 on the support portion 8, and in this state, the contact surface 5 is in a floating state and is prevented from being in contact with the support portion 8 during non-conduction and traveling.

Figure 4:
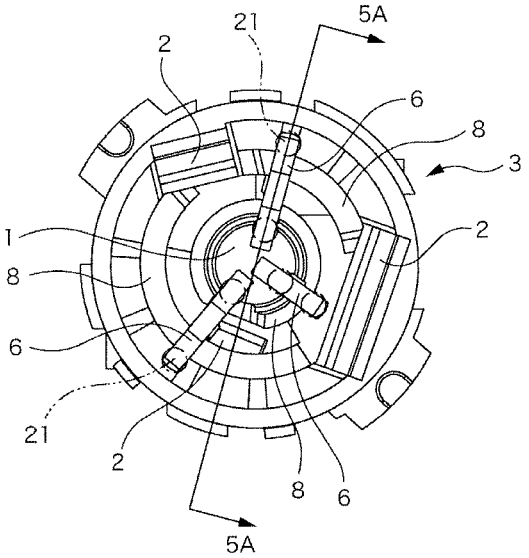
FIG. 4 is a view illustrating a position of a movable contact member at a LOCK position.

When the movable contact member 6 is operated to rotate in the clockwise direction in FIG. 4 from this state, the movable contact member 6 travels on the support portion 8 with the contact portion of the support portion 8 as the sliding portion, and then rides on an inclined surface 8*a* formed at a terminal of the support portion 8. The inclined surface 8*a* is formed to gradually become a low back, the movable contact member 6 moved to the inclined surface 8*a* vertically rotates to a vicinity of a horizontal posture while reducing a vertical rotation angle (see θ: FIG. 5B), and lands on the fixed contact member 2 as illustrated in FIGS. 6(*a*) and 6(*b*).

In this state, the movable contact member 6 is in contact with a bent portion formed by bending an edge of one end portion of the fixed contact member 2 in a longitudinal direction. Furthermore, when the rotational operation with respect to the movable contact member 6 is continued, the contact point with the movable contact member 6 moves to a final contact position which is slight shifted in a direction in which a dimension (δ) in FIGS. 6(*b*) and 7(*b*) increases in a width direction, that is, in a direction approaching a rotation center of the movable contact member 6 on the opposite end side in the longitudinal direction.

Figure 8A:
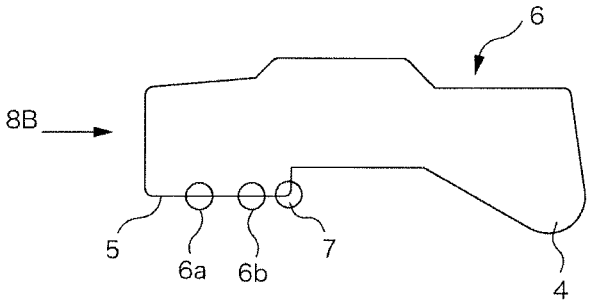
FIG. 8A is a side view illustrating the movable contact member and FIG. 8B is a view as viewed in a direction of arrow 8B of 8A.
Figure 8B:
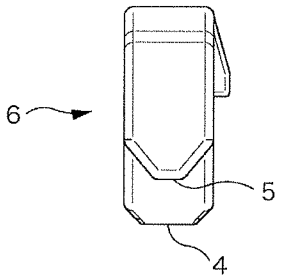

On the other hand, as illustrated in FIGS. 8(*a*) and 8(*b*), the contact point of the contact surface 5 of the movable contact member 6 with the fixed contact member 2 moves from a contact start point 6*a* to a final contact point 6*b* in a direction of the corner portion 7 side with the rotation of the movable contact member 6.

As a result, even in a case where the ignition switch of the example is used for the high current usage and the surface state is deteriorated due to the generation of the arc discharge at the contact start point, since the final contact position is located at a position away from the arc discharge position (contact start point), it is possible to reliably prevent contact failure.

DESCRIPTION OF REFERENCE NUMERALS AND SIGNS

1 center portion contact
2 fixed contact member
3 terminal base
4 contact protrusion part
5 contact surface
6 movable contact member
7 corner portion
8 support portion

What is claimed is:

1. A rotary switch device comprising:

a terminal base to which a center portion contact and a fixed contact member are fixed;

a movable contact member; and a support portion, wherein the movable contact member includes a contact protrusion part which is pressed in contact with the center portion contact at one end of the movable contact member and a first contact surface which is in contact with the fixed contact member at another end of the movable contact member, and which is operated to rotate around the center portion contact so as to short-circuit between the center portion contact and the fixed contact member at a conductive rotation position, wherein the support portion is formed in the terminal base and supports an edge corner portion along a rotation direction when the first contact surface of the movable contact member is operated to rotate, and wherein the moveable contact member is configured to slide on the support portion with the edge corner portion as a sliding contact portion and moves to the conductive rotation position in which the first contact surface is in contact with the fixed contact member.

2. The rotary switch device according to claim 1, wherein the support portion supports the movable contact member at a high position with respect to a plane of the fixed contact member, and in a supporting state, holds the movable contact member in a state that the movable contact member is rotatable in a direction perpendicular to the plane.

3. The rotary switch device according to claim 1, wherein the first contact surface of the movable contact member and a second contact surface of the fixed contact member are formed in rectangular shapes in which a contact portion of the first contact surface of the movable contact member with the second contact surface of the fixed contact member moves from one end portion of the movable contact member to another end portion of the movable contact member in a predetermined connecting operation angle from a start of a contact between the fixed contact member and the movable contact member, and the movable contact member uses the corner portion on a contact end point side as the sliding contact portion with the support portion.

4. The rotary switch device according to claim 3, wherein conductive processing for corrosion resistance is applied to the first contact surface of the movable contact member and the second contact surface of the fixed contact member.

5. The rotary switch device according to claim 1, further comprising:

a plurality of movable contact members that moves on a same circular moving locus.

* * * * *